US010358690B2

(12) United States Patent
Yi et al.

(10) Patent No.: US 10,358,690 B2
(45) Date of Patent: Jul. 23, 2019

(54) STEEL PLATE USED FOR HOT STAMPING FORMING, FORMING PROCESS OF HOT STAMPING AND HOT-STAMPED COMPONENT

(71) Applicant: EASYFORMING STEEL TECHNOLOGY CO., LTD., Chongqing (CN)

(72) Inventors: Hongliang Yi, Liaoning (CN); Pengju Du, Liaoning (CN)

(73) Assignee: EASYFORMING STEEL TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 15/551,325

(22) PCT Filed: May 26, 2015

(86) PCT No.: PCT/CN2015/079748

§ 371 (c)(1),
(2) Date: Aug. 16, 2017

(87) PCT Pub. No.: WO2016/131218

PCT Pub. Date: Aug. 25, 2016

(65) Prior Publication Data

US 2018/0030567 A1 Feb. 1, 2018

(30) Foreign Application Priority Data

Feb. 16, 2015 (CN) ..... 2015 1 0083838

(51) Int. Cl.

| | |
|---|---|
| ***C22C 38/04*** | (2006.01) |
| ***C21D 9/48*** | (2006.01) |
| ***B21D 37/16*** | (2006.01) |
| ***C21D 8/04*** | (2006.01) |
| ***C22C 38/06*** | (2006.01) |
| ***C22C 38/38*** | (2006.01) |
| ***C22C 38/58*** | (2006.01) |
| ***C21D 6/00*** | (2006.01) |
| ***C22C 38/00*** | (2006.01) |
| ***C22C 38/02*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |

(Continued)

(52) U.S. Cl.

CPC ..... *C21D 9/48* (2013.01); *B21D 37/16* (2013.01); *C21D 6/002* (2013.01); *C21D 6/005* (2013.01); *C21D 6/008* (2013.01); *C21D 8/005* (2013.01); *C21D 8/04* (2013.01); *C21D 8/0405* (2013.01); *C21D 9/0068* (2013.01); *C22C 38/002* (2013.01); *C22C 38/02* (2013.01); *C22C 38/06* (2013.01); *C22C 38/08* (2013.01); *C22C 38/12* (2013.01); *C22C 38/14* (2013.01); *C22C 38/16* (2013.01); *C22C 38/20* (2013.01); *C22C 38/22* (2013.01); *C22C 38/24* (2013.01); *C22C 38/26* (2013.01); *C22C 38/28* (2013.01); *C22C 38/38* (2013.01); *C22C 38/42* (2013.01); *C22C 38/58* (2013.01); *B21D 22/022* (2013.01); *C21D 1/18* (2013.01); *C21D 1/673* (2013.01); *C21D 2211/001* (2013.01); *C21D 2211/008* (2013.01)

(58) Field of Classification Search

CPC ..... C22C 38/04; C22C 38/38; C22C 38/26; C21D 9/46; C21D 6/005; C21D 6/002; C21D 6/008; B21D 22/022

See application file for complete search history.

(56) References Cited

U.S. PATENT DOCUMENTS

| | | | | |
|---|---|---|---|---|
| 9,617,614 | B2 | 4/2017 | Hasegawa et al. | |
| 2008/0203744 | A1* | 8/2008 | Fortin | B60R 19/18 293/124 |

(Continued)

FOREIGN PATENT DOCUMENTS

| | | | |
|---|---|---|---|
| CN | 102127675 | A | 7/2011 |
| CN | 102232123 | A | 11/2011 |

(Continued)

OTHER PUBLICATIONS

English Abstract and English Machine Translation of Hanamura et al. (JP 2012-102346) (May 31, 2012).*

(Continued)

*Primary Examiner* — Jessee R Roe
(74) *Attorney, Agent, or Firm* — Michael Best & Friedrich LLP

(57) ABSTRACT

A steel sheet used for hot stamping includes, by weight percent, 0.18~0.42% of C, 4~8.5% of Mn and 0.8~3.0% of Si+Al with the balance being Fe and unavoidable impurities. The alloy elements of the steel sheet enable the actual measured value of the martensitic transformation start temperature after hot stamping to be ≤280° C. The method for manufacturing the component includes: heating the material to 700~850° C. and then stamping; cooling it to the temperature that is 150~260° C. below the martensitic transformation start temperature by cooling in a die, cooling by air, water, or other methods; heating the component to a temperature ranging from 160 to 450° C. and maintaining the temperature for 1 to 100000 seconds for heat treatment, and then cooling the component to room temperature. The formed component has a yield strength of ≥1200 MPa, a tensile strength of ≥1600 MPa and a total elongation of ≥10%.

4 Claims, 4 Drawing Sheets

(51) Int. Cl.

| | |
|---|---|
| ***C22C 38/28*** | (2006.01) |
| ***C22C 38/42*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C21D 8/00*** | (2006.01) |
| ***C21D 9/00*** | (2006.01) |
| *B21D 22/02* | (2006.01) |
| *C21D 1/18* | (2006.01) |
| *C21D 1/673* | (2006.01) |

(56) References Cited

U.S. PATENT DOCUMENTS

| | | | |
|---|---|---|---|
| 2014/0076470 | A1 | 3/2014 | Zhu et al. |
| 2014/0083574 | A1 | 3/2014 | Nam et al. |
| 2014/0308156 | A1 | 10/2014 | Oh et al. |

FOREIGN PATENT DOCUMENTS

| | | | | | |
|---|---|---|---|---|---|
| CN | 102296242 | A | | 12/2011 | |
| CN | 103243275 | A | | 8/2013 | |
| CN | 103397275 | A | | 11/2013 | |
| CN | 104160050 | A | | 11/2014 | |
| EP | 0 483 810 | A2 | * | 5/1992 | ..... C23C 2/26 |
| JP | 2006152427 | A | | 6/2006 | |
| JP | 2012-102346 | | * | 5/2012 | ..... C22C 38/06 |
| JP | WO2016063467 | A1 | | 4/2017 | |
| KR | 101108838 | B1 | | 1/2012 | |
| KR | 20140019838 | A | | 2/2014 | |
| KR | 20140075789 | A | | 6/2014 | |
| WO | WO 2007/024092 | A1 | * | 3/2007 | ..... C22C 38/06 |
| WO | 2015011547 | A2 | | 1/2015 | |
| WO | 2015182591 | A1 | | 12/2015 | |

OTHER PUBLICATIONS

ASM International, Materials Park, Ohio, Properties and Selection: Irons, Steels and High-Performance Alloys, vol. 1, pp. 140-159 , Mar. 1990.*

Notice of Allowance and Written Opinion from the Korean Intellectual Property Office for Application No. 10-2017-7024186 dated May 24, 2018 (3 pages).

Office Action from the Korean Patent Office for Application No. 10-2017-7024186 dated Dec. 1, 2017 (5 pages).

International Search Report and Written Opinion with English translation for Application No. PCT/CN2015/079748 dated Nov. 23, 2015 (14 pages).

First Office Action with English translation from the State Intellectual Property Office of the People's Republic of China for Application No. 201510083838.6 dated Jun. 28, 2016 (19 pages).

Second Office Action with English translation from the State Intellectual Property Office of the People's Republic of China for Application No. 201510083838.6 dated Mar. 17, 2017 (7 pages).

"Table 1, Coated Steel Sheet Mainly Used in the Automobile Industry", Foreign Low Alloy Steel, Alloy Steel, Editorial Department of Foreign Low Alloy Steel, Alloy Steel in Iron and Steel Research Institute of Ministry of Metallurgy, p. 90, Dec. 1993.

Notification to Grant Patent Right for Invention with English translation from the State Intellectual Property Office of the People's Republic of China for Application No. 201510083838.6 dated Jun. 2, 2017, along with the Chinese granted claims and the English translation of the granted claims (9 pages).

Extended European Search Report from the European Patent Office for Application No. 15882357.5 dated Jun. 22, 2018 (12 pages).

C. Capdevila et al: 11 Determination of Ms Temperature in Steels: A Bayesian Neural Network Model. 11, ISIJ International, vol. 42, No. 8, May 31, 2002 (May 31, 2002), pp. 894-902.

* cited by examiner

STEEL PLATE USED FOR HOT STAMPING FORMING, FORMING PROCESS OF HOT STAMPING AND HOT-STAMPED COMPONENT

CROSS-REFERENCE TO RELATED APPLICATIONS

This application is a national stage filing under 35 U.S.C. 371 of International Application No. PCT/CN2015/079748 filed May 26, 2015, which claims the foreign priority benefit of Chinese Patent Application No. 201510083838.6 filed Feb. 16, 2015, which are incorporated by reference herein in their entireties.

TECHNICAL FIELD

The present invention relates to a new steel sheet used for hot stamping, a hot stamping process and an ultrahigh strength-toughness formed component made therefrom, and more particularly, to a new steel sheet used for hot stamping, which manufactures a high strength-toughness component by a hot stamping process for use as a safety structural component and a reinforcement component for vehicles, as well as other high strength-toughness components for vehicles.

BACKGROUND ART

Energy saving, safety and environmental protection are the theme of current vehicle development worldwide, and lightweighting of vehicles plays a very important role. The use of high-strength steels becomes an inevitable trend for the sake of weight reduction and safety. However, an increase in the strength of steel materials generally may lead to a decrease of forming properties, which renders it hard to form a component of complex shape required for vehicle design; meanwhile, springback is a severe problem when cold forming high-strength steels so that it is difficult to precisely control the size and shape of stamped components; and dies are seriously worn during the cold stamping process of high-strength steel materials, which increases stamping costs.

To solve the problem of cold stamping the high-strength steels, a forming method for manufacturing a vehicle component with 1000 MPa or higher strength, referred to as hot stamping or hot forming, is successfully developed and commercially applied on a large scale. The steps of the method comprise: heating a steel sheet into the austenite region of 850 to 950° C.; and putting the steel sheet into a die with a cooling system so as to be formed by stamping at high temperature. At that temperature, the material has a strength of only ~200 MPa and an elongation of more than 40%, as well as good forming properties, and can be formed into a complex component required for vehicle design, and also has a small amount of springback and high forming precision. The steel sheet is subjected to press hardening at the time of stamping so as to obtain a high-strength formed component of a full-martensite structure.

Bare steel may be oxidized in the course of hot forming, which will affect the surface quality of steel, as well as the die. A conventional steel sheet galvanizing technology, however, cannot meet the conditions for hot stamping process. The U.S. Pat. No. 6,296,805B1 provides a steel sheet coated with aluminium or aluminium-silicon alloy used for hot stamping. Iron in the matrix material may be diffused to the aluminium coating to form an iron-aluminium alloy coating during the hot stamping and heating process. At an austenitizing heating temperature, the iron-aluminium coating will not be oxidized and can effectively protect a steel sheet from oxidization during the entire hot stamping process, and the coating can make a certain improvement in the corrosion resistance of the formed component in service. Therefore it is widely used for commercial purposes. However, in comparison with the conventional galvanized steel sheet, the aluminium-silicon coating cannot provide protection against electrochemical corrosion. The Patent No. EP1143029 provides a method for manufacturing a hot stamped component with a galvanized steel sheet that is formed by coating a hot-rolled steel sheet with zinc or zinc alloy. The galvanized zinc coating, however, has a relatively low melting point of about 780° C., and zinc may evaporate and the zinc-iron coating may melt during the hot forming process, which may result in liquid induced embrittlement and reduce the strength of hot formed steel.

The Patent No. CN103392022 provides a hot stamping technology provided on the basis of a quenching-and-partitioning process, which can realize higher strength and elongation; however, it usually requires that the cooling temperature should be controlled within a range of 100° C. to 300° C., which brings difficulties in controlling temperature uniformity on parts and complication to the production process, and is thus disadvantageous to the actual production of hot stamped components; and the temperature for the austenitizing heat treatment is quite high, which is not good for hot stamping of galvanized sheets and consumes lots of energy.

The Patent No. CN101545071 provides a novel hot stamped steel sheet, wherein the austenitizing heating temperature can be reduced by ~50° C., which could lead to the reduction of production cost to certain extent. However, the strength-toughness of the hot stamped steel is not significantly improved as compared with the conventional 22MnB5 hot stamped material.

The Patent No. CN102127675B provides an alloy design and stamping method capable of reducing the hot stamping temperature. The method comprises, under the condition of decreased hot stamping temperature, heating a material to a temperature ranging from 730° C. to 780° C., and stamping and cooling the material to a temperature that is 30° C. to 150° C. below Ms point (namely, normally cooled to 150° C. to 280° C.), then further heating the material to a temperature ranging from 150° C. to 450° C. and maintaining the temperature for 1 to 5 minutes to stabilize it to a final state by partitioning carbon from martensite to retained austenite. By applying this method, the ductility of the hot stamped material could be increased on the basis of the Transformation Induced Plasticity (TRIP) effect of retained austenite, but the yield strength of the material is limited below 1150 MPa when the elongation exceeds 10%. In this method, the component must be cooled to a particular temperature ranging from 150° C. to 280° C. before being heated to a temperature ranging from 150° C. to 450° C. and maintained at the temperature, in such a way that the temperature accuracy and uniformity of the component can be hardly controlled, or a complicated production process is required to control the quenching temperature thereof, which is disadvantageous to the actual production of the hot stamped component.

SUMMARY OF THE INVENTION

One object of the present invention is to provide a steel sheet used for hot stamping, a hot stamping process and a formed component made therefrom. The martensitic transformation start temperature of the steel sheet is relatively low, so as to ensure a quenching at a lower temperature to obtain a match between ultrahigh strength and toughness of the component. As the martensitic transformation start temperature point (Ms) of the material is designed to be 280° C. or less, in the hot stamping process of the present invention, the quenching temperature is usually set to be 150 to 260° C. below the martensitic transformation start temperature point (Ms), which allows the material to be cooled conveniently in a medium at a temperature ranging from 0 to 100° C., e.g. in air or in cold water, warm water or hot water before being separately reheated and maintained at a higher temperature. Thus, the temperature control is easy to operate with good temperature uniformity and precision on a component, and uniform and good structural properties can be obtained. In the present invention, the stamped component is directly cooled to a temperature that is 150° C. to 260° C. below the Ms point (namely, usually cooled to 0 to 100° C.) and then reheated and maintained at a higher temperature, ensuring a match between ultrahigh strength and toughness of the stamped component. The mechanical properties thereof can reach a tensile strength of 1600 MPa or more, a yield strength of 1200 MPa or more and meanwhile an elongation of 10% or more.

According to one aspect of the present invention, there is provided a steel sheet used for hot stamping. The steel sheet comprises by weight percent 0.18 to 0.42% of C, 4~8.5% of Mn and 0.8~3.0% of Si+Al with the balance being Fe and unavoidable impurities, wherein the alloy elements of the steel sheet enable the actual measured value of the martensitic transformation start temperature of the steel sheet after hot stamping to be ≤280° C. The smaller fractions of retained austenite are not conducive to improving the ductility of the component, whereas the excess volume fractions of retained austenite result in decrease of austenite stability, leading to earlier TRIP effect thereof in the course of tensile deformation or collision deformation, which is not good to improving the strength-toughness of the component. In order to obtain the retained austenite with reasonable stability and reasonable volume fractions, it is necessary to design a reasonable martensitic transformation start temperature and a corresponding quenching temperature. In order to cool the component by, e.g., air or by water of 0° C. to 100° C., the present invention sets the quenching temperature of the formed component to a certain temperature in the range of 0° C. to 100° C. In order to obtain a high strength-toughness component containing retained austenite with reasonable stability and reasonable volume fractions, the present invention designs the alloy elements of the steel sheet to meet the requirement that the martensitic transformation start temperature be ≤280° C.

The steel sheet of the present invention is based on a high-Mn design, in which the Mn content is between 4 and 8.5%, preferably between 5 and 7.5%. Manganese can reduce the martensitic transformation start temperature. The coupling of Manganese and Carbon in the steel of the present invention is designed to reduce the martensitic transformation start temperature of the material below 280° C. to ensure that the cooling conditions of the hot stamped component enable the component to retain austenite with reasonable volume fractions in the case of, e.g., room temperature cooling or warm water quenching to improve the mechanical properties of the component. Manganese can reduce the austenitizing temperature of the steel used for hot stamping, so that the austenitizing heating temperature of the galvanized steel used for hot stamping can be less than 780° C. in the hot stamping process, which inhibits liquefaction and severe oxidation of zinc, avoids liquid zinc embrittlement, and meanwhile saves energy due to the reduced austenitizing temperature. Since Mn has an excellent effect of inhibiting the transition from austenite to ferrite, the high Mn content can improve the hardenability of steel. However, the applicant found that the excessively high Mn content, namely, more than 8.5%, will result in that the material after quenching forms a brittle martensite, thereby reducing the ductility of the steel sheet. Thus, the upper limit of manganese should not be too high, preferably at 8.5%. The applicant found that the Mn content between 4 and 8.5% can realize the optimum combination of high hardenability and high strength-toughness.

According to a preferred embodiment of the present invention, the steel sheet further comprises at least one of the following components: 5% or less of Cr; 2.0% or less of Mo; 2.0% or less of W; 0.2% or less of Ti; 0.2% or less of Nb; 0.2% or less of Zr; 0.2% or less of V; 2.0% or less of Cu and 4.0% or less of Ni; and 0.005% or less of B. The applicant found that the combination of at least one of these components and the above basic components will reduce the austenitizing temperature of the steel and further ensure that the martensitic transformation start temperature point is reduced below 280° C., or refine the original austenite grain size, thereby further ensuring a match between ultrahigh strength and toughness of the stamped component, in such a manner that the mechanical properties thereof can reach a tensile strength of 1600 MPa or more, a yield strength of 1200 MPa or more and meanwhile an elongation of 10% or more.

According to a preferred embodiment of the present invention, the steel sheet comprises a hot-rolled steel sheet, a cold-rolled steel sheet, or a steel sheet with a coating. The steel sheet with a coating may be a galvanized steel sheet, which is a hot-rolled steel sheet or a cold-rolled steel sheet with a metallic zinc coating formed thereon. The galvanized steel sheet comprises one selected from the group consisting of hot-dip galvanized (GI), galvannealed (GA), zinc electroplated or zinc-iron electroplated (GE). The steel sheet with a coating may be a hot-rolled steel sheet or a cold-rolled steel sheet with an aluminium-silicon coating formed thereon, or a steel sheet with an organic coating, or a steel sheet with other alloyed coatings.

According to a second aspect of the present invention, there is also provided a hot stamping process, which comprises the steps of: a) providing a steel sheet of any component described in above first aspect or its preformed component; b) heating the steel sheet or its preformed component to a temperature ranging from 700 to 850° C.; c) transferring the heated steel sheet or its preformed component to a die for stamping so as to obtain a formed component; and d) cooling the formed component to a temperature that is 150 to 260° C. below the martensitic transformation start temperature point. Those skilled in the art should understand that so long as the temperature of the formed component can be reduced to a temperature that is 150 to 260° C. below the martensitic transformation start temperature point, any cooling method can be used, such as cooling within a die, or cooling in air, or cooling by water of 0 to 100° C., that is, no limitation is imposed on the cooling method. The cooling temperature may be preferably a room temperature, or even lower. The heating temperature of the steel sheet of the present invention is maintained at a temperature ranging from 700 to 850° C. so as to ensure that the galvanized sheet can also be formed by hot stamping, or even indirectly formed by hot stamping. Additionally, the heating temperature is relatively low, which can greatly save energy and decrease the costs for assorted equipment for high temperature heating. According to the hot stamping process of the present invention, the quenching temperature is greatly reduced as compared with the conventional temperature in the art (e.g., 150 to 280° C. as mentioned above in the Patent No. CN102127675B) and can be controlled below 100° C. such that the cooling control method can be more flexible, such as cooling by air or by water of 0 to 100° C. (namely quenching in hot water), in such a manner that water, the cheapest and most easily controllable quenching medium, can be applied in the hot stamping process, achieving an advantageous effect of uniform temperature and easy controllability. Moreover, it can also save thermal energy and reduce the costs of assorted equipment for high temperature quenching. Further, the initial austenite volume fraction of the component before the heat treatment can be controlled to be lower than 23% by the hot stamping process of the present invention.

According to a preferred embodiment of the present invention, a heat treatment step can also be conducted after the step d), i.e., heating the formed component to a temperature ranging from 160 to 450° C. and maintaining the temperature for 1 to 100000 seconds, then cooling the formed component to room temperature by any cooling method and under any cooling condition so as to optimize the structure and properties of the formed component, enable that the transformed martensite is retransformed to austenite to increase the austenite fraction to no more than 32%, then the carbon is partitioned from martensite to austenite to stabilize the austenite, so as to obtain a formed component with a yield strength of ≥1200 MPa, a tensile strength of ≥1600 MPa and a total elongation of ≥10%.

According to a preferred embodiment of the present invention, the heat treatment step can be conducted after the quenched formed component is placed for a period of time, i.e., the heat treatment step is not necessarily conducted immediately after the quenching step. Those skilled in the art should understand that since the QP (quenching-partitioning) process in the prior art requires that the quenching temperature should be controlled to a temperature above 100° C., in order to keep the temperature of the component not lower than the quenching temperature, the formed component shall be immediately heated to the partitioning temperature of 250° C. or more, which is not advantageous to the process implementation and production line layout. In contrast, since the quenching temperature in the present invention can be lowered below 100° C., such as controlled to be room temperature or lower, the heat treatment step of the present invention is not necessarily conducted immediately after the quenching, e.g., the component can be placed at room temperature for any time period before the heat treatment, which is conducive to the production line layout, process and production pacing arrangement in the practical hot stamping industry. Additionally, the hot stamped component can undergo the heat treatment at any location, such as in a heat treatment workshop far away from the hot stamping production lines, or during a component transportation process, or in a vehicle final assembly line.

According to a third aspect of the present invention, there is provided a formed component manufactured of the steel sheet having any component of the above first aspect by means of any hot stamping process of the above second aspect, wherein the microstructure of the formed component after the step d) comprises, by volume, 3% to 23% of retained austenite, 10% or less of ferrite, with the balance being martensite, or further containing 2% or less of carbides. Moreover, the formed component may be subjected to the heat treatment after the step d), and the microstructure of the formed component at this time comprises, by volume, 7% to 32% of retained austenite, 10% or less of ferrite, with the balance being martensite, or further containing 2% or less of carbides, so as to obtain a formed component with a yield strength of ≥1200 MPa, a tensile strength of ≥1600 MPa and a total elongation of ≥10%.

According to a preferred embodiment of the present invention, the formed component can be used as at least one of a vehicle safety structural component, a reinforcement structural component and a high strength-toughness vehicle structural component. To be specific, the formed component can be used as at least one of a B-pillar reinforcement, a bumper, a car door beam and a wheel spoke. Of course, the formed component can also be used in all other components for land vehicles requiring light-weighted and high-strength or high-strength and high-ductility.

According to a fourth aspect of the present invention, there is also provided a heat treatment method for improving the strength-toughness of a hot stamped component, comprising: heating any of abovementioned steel sheet or its preformed component to a temperature ranging from 700 to 850° C., and then stamping the same to obtain a formed component, wherein the steel sheet or its preformed component is maintained at the temperature range for 1 to 10000 seconds; cooling the formed component to a temperature that is 150 to 260° C. below the martensitic transformation start temperature point, the cooling method comprising cooling in a die, cooling by air, and cooling by water of 0° C. to 100° C., with a cooling rate being 0.1 to 1000° C./s; heating the cooled formed component again to a temperature range lower than or equal to Ac1 for heat treatment, and maintaining the formed component at the temperature range for 1 to 100000 seconds; and further cooling the formed component to room temperature by any cooling method and under any cooling condition. By using the heat treatment method of the present invention, the quenching temperature can be controlled to a temperature (which can be realized by hot water quenching) below 100° C., achieving an advantageous effect of uniform temperature and easy controllability. Moreover, it can also save thermal energy and reduce the costs of assorted equipment for high temperature quenching. Further, a portion of transformed martensite can be retransformed to austenite to increase the austenite fraction, which is usually not more than 32%, and then carbon partitioning may occur to stabilize austenite.

According to the technical solution of the present invention, at least the following advantages can be obtained:

1. In comparison with the prior art, the steel sheet of the present invention has a low austenizing temperature and low quenching temperature that may be less than 100° C., which is better for temperature control, temperature uniformity, uniform structural properties of the component and energy saving.

2. Based on the composition design, during the heat treatment (carbon partitioning) process, the amount of austenite will obviously increase under preferable conditions and the newly generated austenite will obviously be good to improving the strength-toughness of steel.

3. In comparison with the direct quenching process in the prior art, the steel of the present invention obtains a higher yield strength of 1200 MPa or more, and the high yield strength is an important index to improve the performance of vehicle structural components.

4. In comparison with conventional steel sheet used for hot stamping, the steel sheet of the present invention has a high hardenability, and its hot stamped component obtains an ultrahigh strength-elongation product with a yield strength of 1200 MPa or more, a tensile strength of 1600 MPa or more and an elongation of 10% or more.

DETAILED DESCRIPTION OF THE INVENTION

Figure 1A:
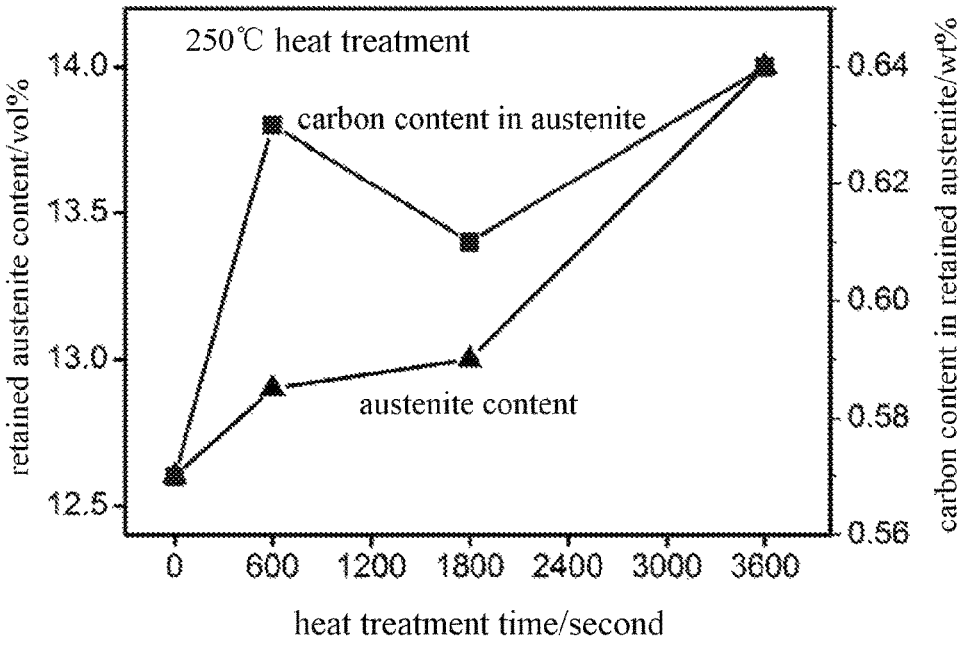
FIG. 1A and FIG. 1B show the variation in the amount of retained austenite in a hot-rolled sheet of the steel of the present invention.

The present invention will be described in detail with reference to the embodiments. The embodiments are intended to explain exemplary technical solutions and the present invention is not limited to these embodiments.

The present invention provides a steel sheet which can be galvanized and directly hot stamped, and a formed component of the steel sheet, and provides a method for producing the formed component, and a heat treatment method for improving the strength-toughness of the hot stamped component. The formed component may have a yield strength of 1200 MPa or more, a tensile strength of 1600 MPa or more and an elongation of 10% or more. The method for producing the formed component requires a relatively low heating temperature, which can greatly save energy. The galvanized steel sheet can be directly used for hot stamping and remain sufficient strength. When being manufactured, the formed component is quenched to a temperature that is 150 to 260° C. below the martensitic transformation start temperature point, and may be cooled by air to room temperature or by warm water quenching, realizing uniform temperature and easy controllability.

The chemical components (by weight percent) of the steel of the present invention are defined for the following reasons:

C: 0.18% to 0.42%

Carbon is the cheapest strengthening element that can greatly increase the strength of steel by interstitial solid solution. And the increase in the carbon content will greatly reduce Ac3, thereby reducing the heating temperature and saving energy. Although carbon can greatly reduce the martensitic transformation start temperature, the requirements of the alloy design for the martensitic transformation start temperature being ≤280° C. and the requirements for the microstructure of the steel must be met, and carbon is the most important interstitial solid solution strengthening element, therefore the lower limit of the carbon content is 0.18%. However, an excessively high carbon content may result in poor weldability of steel and cause a great increase in strength and decrease in toughness of the sheet, therefore the upper limit of carbon is 0.42%. A preferred value is between 0.22% and 0.38%.

Mn: 4% to 8.5%, Cr: 5% or Less

Mn is an important element in the present invention. Mn is a good deoxidizer and desulfurizer. Mn is an austenite stabilizing element that can expand the austenite region and reduce the Ac3 temperature. Mn has a good effect on inhibiting the transformation of austenite to ferrite and improving hardenability of steel. Cr can improve oxidation resistance and corrosion resistance, and is an important alloy element in stainless steel. Cr is a moderate strong carbide forming element. It can not only improve the strength and hardness of steel by solid solution strengthening, but also improve the stability of austenite and increase the hardenability of steel as its diffusion rate in austenite is low and it can inhibit carbon diffusion. The increase in the Cr content can greatly improve the amount of retained austenite after quenching. The percentage of Mn and Cr in steel is determined according to the requirements of the alloy design for the martensitic transformation start temperature and the carbon content in steel. One or both of the two elements, Mn and Cr, can be added. In order to decrease the heating temperature during the heat treatment, the lower limit of Mn is set to be 4% so as to ensure that the martensitic transformation start temperature is ≤280° C., and meanwhile the complete austenitizing temperature (Ac3) of the material is guaranteed to be ≤730° C. so as to ensure that the galvanized sheet can be formed by hot stamping. Addition of too much Mn may result in that the material after quenching forms a brittle ξ martensite, therefore the upper limit of Mn is set to be 8.5%. The addition of Cr, together with Mn, may further reduce the martensitic transformation start temperature and the complete austenitizing temperature of the material, but Cr has a relatively weak capability in reducing the martensitic transformation start temperature and the complete austenitizing temperature as compared with that of Mn, and costs higher than Mn, therefore its upper limit is set to be 5%. Mn preferably ranges from 4.5 to 7.5%, and Cr is preferably not added due to its higher cost.

Si+Al: 0.8% to 3.0%

Si and Al can both inhibit the formation of carbides. When the steel is maintained at a temperature range below the Ac1 temperature after being quenched to room temperature, Si and Al can both inhibit precipitation of carbides in martensite and partition carbon from martensite to retained austenite to improve the stability of austenite and improve the strength-ductility of steel. The addition of too little Si and Al cannot sufficiently inhibit the precipitation of carbides in the course of hot stamping, therefore the lower limit of Si+Al is 0.8%. In the industrial production, too much Al may block the nozzle in the continuous casting, increasing the difficulty in continuous casting, and Al may increase the martensitic transformation start temperature and the complete austenitizing temperature of the material, which does not meet the requirement of structure temperature control of the steel of the present invention, therefore the upper limit of Al is set to be 1.5%. A high Si content will lead to more impurities in steel, therefore the upper limit of Si is set to be 2.5%, and the upper limit of Si+Al is set to be 3.0%. The preferred value of Si ranges from 0.8 to 2%, and the preferred value of Al is less than 0.5%.

P, S and N Unavoidable Impurities

In general, P is a harmful element in steel, which may increase the cold brittleness of steel, worsen the weldability, reduce the plasticity and deteriorate the cold bending property. Generally speaking, S is also a harmful element, which may cause hot brittleness of steel, and reduce the ductility and weldability of steel. N is an unavoidable element in steel. N is similar to carbon in terms of strengthening effect and is helpful in bake hardening.

Mo and W: 2.0% or Less

Mo and W can improve the hardenability of steel, and effectively increase the strength of steel. In addition, even if the steel sheet is not sufficiently cooled due to its unstable contact with the die during the high-temperature forming process, the steel may still have a suitable strength due to the increased hardenability resulting from Mo and W. In the case of Mo and W being greater than 2%, no additional effects can be achieved, and costs will rise instead. Since the design of high Mn content in steel of the present invention has high hardenability, there is preferably no need to add extra Mo and W for the sake of lowered costs.

Ti, Nb, Zr and V: 0.2% or Less

Ti, Nb, Zr and V refine the crystalline grains of steel, increase the strength of steel and render the steel a good heat treatment properties. The excessive low concentration of Ti, Nb, Zr and V does not work, but more than 0.2% thereof will increase unnecessary costs. The steel of the present invention can obtain a strength of more than 1600 MPa and good ductility because of a reasonable design of C and Mn, therefore there is preferably no need to add extra Ti, Nb, Zr and V for the sake of reduced costs.

Cu: 2.0% or Less, Ni: 4% or Less

Cu can increase the strength and toughness, especially atmospheric corrosion resistance. When the Cu content is greater than 2%, the processability may be deteriorated, and a liquid phase may be formed during hot rolling, which results in cracking. The high Cu content may also cause an increase in unnecessary costs. Ni can increase the strength of steel and maintain the good plasticity and toughness of steel. If the concentration of Ni is more than 4.0%, the costs will be increased. The steel of the present invention can obtain a strength of more than 1600 MPa and good ductility because of a reasonable design of C and Mn, therefore there is preferably no need to add extra Cu and Ni for the sake of reduced costs.

B: 0.005% or Less

The segregation of B at austenite grain boundaries prevents the nucleation of ferrite, which may greatly improve the hardenability of steel, and significantly improve the strength of steel after the heat treatment. The B content of more than 0.005% cannot obviously make improvement. Since the design of high Mn in steel of the present invention has a high hardenability, there is preferably no need to add extra B for the sake of reduced costs.

An object of the present invention is to produce a steel sheet with a yield strength of 1200 MPa or more, a tensile strength of 1600 MPa or more and an elongation of 10% or more. The steel sheet comprises a hot-rolled steel sheet, a cold-rolled steel sheet, and a galvanized steel sheet. The microstructure of the steel sheet before heat treatment comprises, by volume, 3% to 23% of retained austenite, 10% or less (inclusive of 0%) of ferrite, with the balance being martensite, or further containing 2% or less of carbides. The steel sheet can be galvanized and directly formed by hot stamping.

The method for manufacturing the formed component will be described. The steel sheet is processed by stamping, and heated to a temperature ranging from 700 to 850° C., preferably from 730 to 780° C., before the hot stamping. As for the preformed component of the steel sheet, after the cold stamping, it is heated to a temperature ranging from 700 to 850° C., preferably from 730 to 780° C. Subsequently, the stamped steel sheet is cooled within a die, or by air, or by other cooling method, to a temperature that is 150 to 260° C. below the martensitic transformation start temperature, preferably cooled to a temperature from room temperature to 100° C. Then, the microstructure of the formed component comprises, by volume, 3% to 23% of retained austenite, 10% or less (inclusive of 0%) of ferrite, with the balance being martensite, or further containing 2% or less of carbides. Too much retained austenite will render it unstable, whereas excessively high martensite content will render the amount of retained austenite insufficient, and a high amount of formed carbides will reduce the carbon content in austenite rendering it unstable, in such a way that the requirement of the present invention for elongation cannot be met. Deformation induced ferrite may occur during the hot forming process, and the amount of ferrite should not exceed 10% in order to achieve the desired strength.

Then, the stamped component is cooled to room temperature after the heat treatment in which the stamped component is maintained at a temperature ranging from 160 to 450° C. for 1 to 10000 seconds. The microstructure of the heated formed component at this time comprises, by volume, 7% to 32% of retained austenite, 10% or less (inclusive of 0%) of ferrite, with the balance being martensite, or further containing 2% or less of carbides. During the heat treatment, carbon is partitioned from martensite to austenite to stabilize austenite, such that the component in the final state of use has a reasonable austenite volume fraction in steel and stability in order to obtain high strength-toughness. It should be noted that according to the heat treatment process of the present invention, the volume percentage of austenite in steel can be increased by 2% or more as compared with that before the heat treatment.

The design on the alloy component in the steel of the present invention shall meet the requirement that the actual measured value of the martensitic transformation start temperature of the steel is ≤280° C. Addition of alloy elements will obviously reduce the austenitizing temperature of the steel. The steel sheet or the preformed component is formed by stamping after being heated to a temperature ranging from 700 to 850° C., preferably 730 to 780° C., wherein the steel sheet is maintained at the temperature range for 1 to 10000 seconds. It is then cooled to a temperature that is 150 to 260° C. below the martensitic transformation start temperature point, preferably cooled below 100° C. to room temperature or even a lower temperature. The cooling method comprises cooling in a die, cooling by air, hot water or cold water, or other cooling methods, with a cooling rate being 0.1 to 1000° C./s. The stamped and cooled component is heated again to a temperature range lower than or equal to Ac1 for heat treatment, and the steel sheet is maintained at the temperature range for 1 to 10000 seconds. It is then cooled to room temperature by any cooling method and under any cooling condition. If the maintenance time is less than 1 second, carbon may not be sufficiently diffused into retained austenite; and if it is larger than 10000 seconds, the austenite may be overly softened and the strength of the steel sheet may be decreased to an extent that cannot meet the requirement of the design.

During the heat treatment, carbon is partitioned from martensite to austenite to stabilize austenite, which can improve the strength-toughness of steel. In a preferable case, after a low-temperature heat treatment, the volume percentage of retained austenite in steel will obviously increase by 2% or more as compared with that before the heat treatment. The newly generated austenite will apparently increase the plasticity of steel and is conducive to preventing cracks from expansion, thereby greatly enhancing the strength-elongation product of steel.

The experiments based on the steel sheet of the present invention will be described. The steel ingot having the elements as determined in Table 1 shall be homogenized by maintaining temperature for 10 hours at 1200° C. and then maintained for 1 hour at a temperature between 1000 to 1200° C. and then hot rolled into a hot-rolled sheet. The hot-rolled sheet or hot-rolled pickling sheet is maintained for 5 to 32 hours at a temperature ranging from 600 to 700° C., and simulated batch annealing is performed to reduce the strength of the hot-rolled sheet and is advantageous to cold rolling. Then the hot-rolled picking sheet or hot-rolled pickling annealing sheet is cold rolled to 1.5 mm. In Table 1, No.IS1 to IS11 are the steels of the present invention, and No. CS1 to CS5 are contrast steels containing components recorded in the prior art.

TABLE 1

| Chemical Components of Steel | | | | |
|---|---|---|---|---|
| | Chemical components (weight %) | | | |
| No. | C | Mn | Si | others |
| IS1 | 0.3 | 6.66 | 1.05 | |
| IS2 | 0.18 | 8.5 | 1.72 | |
| IS3 | 0.28 | 6.22 | 1.57 | |
| IS4 | 0.42 | 5.3 | 1.75 | 0.5Al, 0.05Ti, 0.05V, 0.05Nb, |
| IS5 | 0.27 | 5.75 | 1.05 | |
| IS6 | 0.3 | 6.71 | 1.65 | |
| IS7 | 0.33 | 5.09 | 1.63 | |
| IS8 | 0.28 | 4.0 | 1.75 | |
| IS9 | 0.40 | 6.95 | — | 2Al |
| IS10 | 0.3 | 6.5 | 1.7 | 2.9Cr, 0.5Cu, 1Ni |
| IS11 | 0.3 | 6.5 | 1.7 | 0.5Mo, 0.5W |
| CS1 | 0.31 | 3.03 | 1.6 | |

TABLE 1-continued

| Chemical Components of Steel | | | | |
|---|---|---|---|---|
| | Chemical components (weight %) | | | |
| No. | C | Mn | Si | others |
| CS2 | 0.11 | 3.03 | 1.6 | |
| CS3 | 0.11 | 4.84 | | |
| CS4 | 0.2 | 4.92 | 1.7 | |
| CS5 | 0.22 | 1.2 | 0.2 | |

Then, the steel sheet containing the above components is formed by hot stamping using the process parameters shown in Table 2. To be specific, the steel sheet or its preformed component of the present invention is heated in a furnace to a temperature ranging from 700 to 850° C. (AT) and maintained at the temperature for 10 minutes, and then transformed to a die for hot stamping, and the formed component is cooled by air or by other method to a temperature below 100° C. (QT). After a time period, the processed formed component is heated to a temperature ranging from 180 to 500° C. (TT) and maintained at the temperature for a time period for heat treatment, and then cooled to room temperature. In addition, the contrast steel sheet is formed and heat treated according to the parameters of the hot stamping process in the prior art as shown in Table 3. It shall be noted that in Tables 2 and 3, IS is the steel of the present invention, AT is the austentizing temperature, TT is a heat treatment temperature, Ms is the martensitic transformation start temperature. The balance temperatures Ae1 and Ae3 in the Tables are calculated according to the components of steel by thermodynamical software Thermal-cal.

TABLE 2

| No. | | | | | heat treatment conditions | | | |
|---|---|---|---|---|---|---|---|---|
| steel type | sample No. | Ae3/ ° C. | Ae1/ ° C. | Ms/ ° C. | AT/ ° C. | one-step cooling temperature/° C. | TT/ ° C. | Heat Treatment Time,/min |
| IS1 | ISP1 | 690 | 495 | 201 | 850 | 0° C. | 250 | 30 |
| | ISP2 | | | | 850 | 0° C. | 250 | 60 |
| | ISP3 | | | | 850 | 0° C. | 300 | 5 |
| | ISP4 | | | | 850 | 0° C. | 300 | 10 |
| | ISP5 | | | | 760 | 0° C. | 250 | 10 |
| | ISP6 | | | | 760 | 0° C. | 250 | 30 |
| | ISP7 | | | | 760 | 0° C. | 250 | 60 |
| | ISP8 | | | | 760 | 0° C. | 300 | 5 |
| | ISP9 | | | | 760 | 0° C. | 300 | 10 |
| IS2 | ISP10 | 682 | 323 | 204 | 780 | room temperature 15° C. | 250 | 30 |
| | ISP11 | | | | 750 | room temperature 15° C. | 300 | 10 |
| IS3 | ISP12 | 704 | 524 | 219 | 760 | 30° C. | 250 | 30 |
| | ISP13 | | | | 760 | 30° C. | 300 | 10 |
| IS4 | ISP14 | 723 | 609 | 219 | 780 | 40° C. | 250 | 30 |
| | ISP15 | | | | 780 | 40° C. | 300 | 10 |
| IS5 | ISP16 | 708 | 531 | 242 | 760 | 80° C. | 250 | 30 |
| | ISP17 | | | | 760 | 80° C. | 300 | 10 |
| IS6 | ISP18 | 692 | 511 | 196 | 700 | room temperature 15° C. | 300 | 10 |
| | ISP19 | | | | 740 | room temperature 15° C. | 300 | 10 |
| | ISP20 | | | | 760 | room temperature 15° C. | 250 | 10 |
| IS7 | ISP21 | 722 | 592 | 232 | 760 | 60° C. | 300 | 30 |
| | ISP22 | | | | 760 | 60° C. | 300 | 60 |
| IS8 | ISP23 | 744 | 605 | 255 | 850 | 100° C. | 250 | 30 |
| | ISP24 | | | | 850 | 100° C. | 300 | 10 |
| IS9 | ISP25 | 782 | 525 | 217 | 850 | room temperature 15° C. | 300 | 10 |

TABLE 2-continued

| No. steel type | sample No. | Ae3/ ° C. | Ae1/ ° C. | Ms/ ° C. | heat treatment conditions AT/ ° C. | one-step cooling temperature/° C. | TT/ ° C. | Heat Treatment Time,/min |
|---|---|---|---|---|---|---|---|---|
| IS10 | ISP26 | 750 | 490 | 178 | 760 | room temperature 15° C. | 250 | 30 |
| | ISP27 | | | | 760 | room temperature 15° C. | 300 | 10 |
| IS11 | ISP28 | 758 | 517 | 200 | 760 | room temperature 15° C. | 250 | 30 |
| | ISP29 | | | | 760 | | 300 | 10 |

TABLE 3

| No. steel type | sample No. | Ae3/ ° C. | Ae1/ ° C. | Ms/ ° C. | heat treatment conditions AT/ ° C. | quenching temperature/° C. | partitioning temperature/° C. | partitioning time/min |
|---|---|---|---|---|---|---|---|---|
| CS1 | CSP1 | 804 | 680 | 293 | 900 | 201 | 423 | 10 s |
| | CSP2 | | | | 900 | 198 | 423 | 100 s |
| | CSP3 | | | | 900 | 176 | 419 | 500 s |
| CS2 | CSP4 | 852 | 669 | 377 | 900 | 269 | 421 | 10 s |
| CS3 | CSP5 | | | | 750 | 150 | cooling by air ro room temperature | — |
| CS4 | CSP6 | | | | 750 | 150 | cooling by air ro room temperature | — |
| | CSP7 | | | | 750 | 200 | 250 | 10 |
| | CSP8 | | | | 750 | 200 | 300 | 10 |
| CS5 | CSP9 | | | | 930 | room temperature | — | — |

After the above hot forming and heat treatment process, the mechanical properties of different steel and corresponding heat treatment process at room temperature are analyzed, the result of which is shown in Table 4. IS in Table 4 still represents the steel of the present invention, while CS indicates the contrast steel. In addition, YS indicates yield strength, TS indicates tensile strength, TE indicates total elongation, HR is hot-rolled steel, and CR is cold-rolled steel. In addition, tensile specimens in Table 4 are ASTM standard specimens having a 50 mm gauge length, and the strain rate of tensile mechanical properties tests is $5\times10^{-4}$.

TABLE 4

| No. steel type | sample No. | steel plate type | YS/Mpa | TS/Mpa | TE/% |
|---|---|---|---|---|---|
| IS1 | ISP1 | HR | 1274 | 1784 | 14.2 |
| | ISP2 | HR | 1263 | 1754 | 15.1 |
| | ISP3 | HR | 1290 | 1741 | 16.2 |
| | ISP4 | HR | 1230 | 1690 | 16.1 |
| | ISP5 | CR | 1250 | 1830 | 15 |
| | ISP6 | CR | 1247 | 1800 | 15.8 |
| | ISP7 | CR | 1279 | 1794 | 17.1 |
| | ISP8 | CR | 1297 | 1748 | 14.7 |
| | ISP9 | CR | 1292 | 1729 | 15.5 |
| IS2 | ISP10 | CR | 1245 | 1634 | 15.6 |
| | ISP11 | CR | 1210 | 1593 | 16.4 |
| IS3 | ISP12 | CR | 1316 | 1795 | 15 |
| | ISP13 | CR | 1284 | 1776 | 14.6 |
| IS4 | ISP14 | CR | 1520 | 2040 | 10.9 |
| | ISP15 | CR | 1490 | 1998 | 11.6 |
| IS5 | ISP16 | CR | 1256 | 1790 | 14 |
| | ISP17 | CR | 1248 | 1763 | 13.2 |
| IS6 | ISP18 | CR | 1317 | 1731 | 12.8 |
| | ISP19 | CR | 1374 | 1765 | 15.2 |
| | ISP20 | CR | 1340 | 1854 | 15.5 |

TABLE 4-continued

| No. steel type | sample No. | steel plate type | YS/Mpa | TS/Mpa | TE/% |
|---|---|---|---|---|---|
| IS7 | ISP21 | CR | 1386 | 1894 | 12.4 |
| | ISP22 | CR | 1364 | 1863 | 13.6 |
| IS8 | ISP23 | CR | 1258 | 1793 | 14.9 |
| | ISP24 | CR | 1217 | 1734 | 16.6 |
| IS9 | ISP25 | HR | 1210 | 1620 | 14.5 |
| IS10 | ISP26 | HR | 1356 | 1830 | 16.8 |
| | ISP27 | HR | 1374 | 1812 | 14.5 |
| IS11 | ISP28 | HR | 1380 | 1857 | 16.5 |
| | ISP29 | HR | 1391 | 1849 | 15.6 |
| CS1 | CSP1 | CR | 971 | 1594 | 14.8 |
| | CSP2 | CR | 1063 | 1479 | 16.8 |
| | CSP3 | CR | 1013 | 1445 | 17.7 |
| CS2 | CSP4 | CR | 1003 | 1194 | 13.7 |
| CS3 | CSP5 | | 1030 | 1450 | 11 |
| CS4 | CSP6 | | 1100 | 1880 | 12 |
| | CSP7 | | 1008 | 1530 | 16 |
| | CSP8 | | 1020 | 1460 | 16 |
| CS5 | CSP9 | | 1200 | 1500 | 7 |

It can be known from the mechanical properties data shown in Table 4, a formed component with an excellent combination of strength and elongation can be made of the steel sheet having the components of the present invention by the hot stamping process of the present invention. To be specific, it can make a formed component with a yield strength of ≥1200 MPa, a tensile strength of ≥1600 MPa and a total elongation of ≥10%. In contrast, the formed component made of the steel sheet having the components in the prior art by the hot stamping process in the prior art has a lower comprehensive performance, and the yield strength thereof is lower than 1200 MPa when the elongation is greater than 10%. Because the yield strength is an important parameter to evaluate the performance of vehicle safety structural components, the formed component made of the steel sheet of the present invention by the hot stamping process of the present invention achieves a comprehensive performance much better than the existing technology.

Figure 1B:
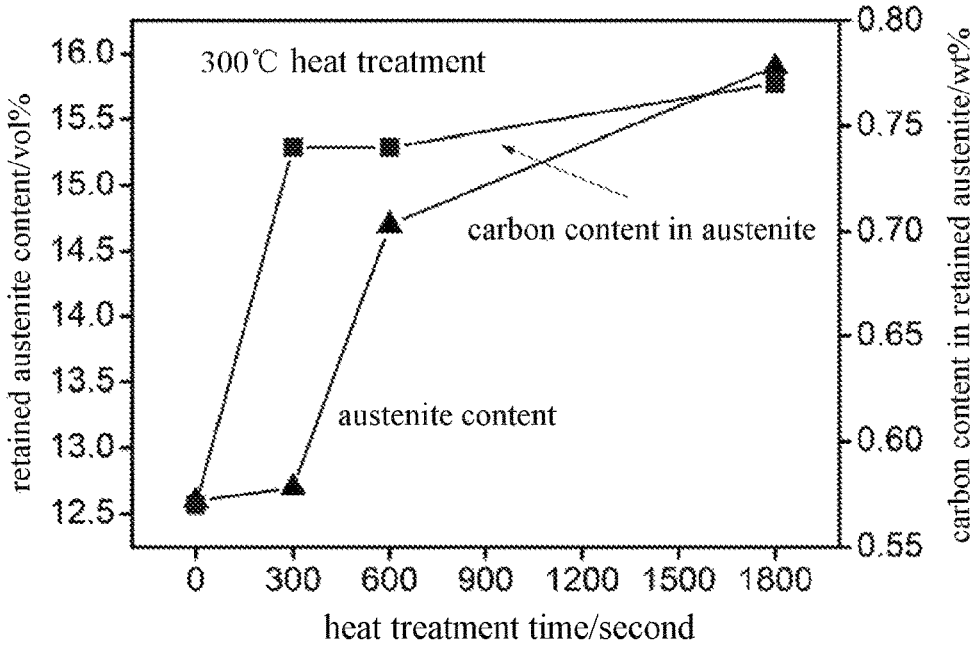
Figure 2A:
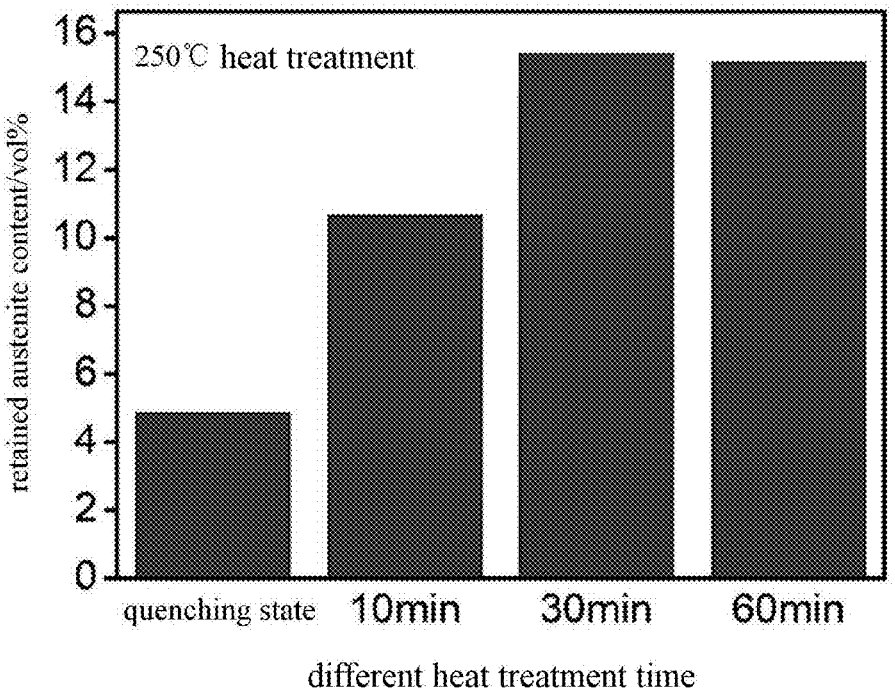
FIG. 2A and FIG. 2B show the variation in the amount of retained austenite in a cold-rolled sheet of the steel of the present invention.
Figure 2B:
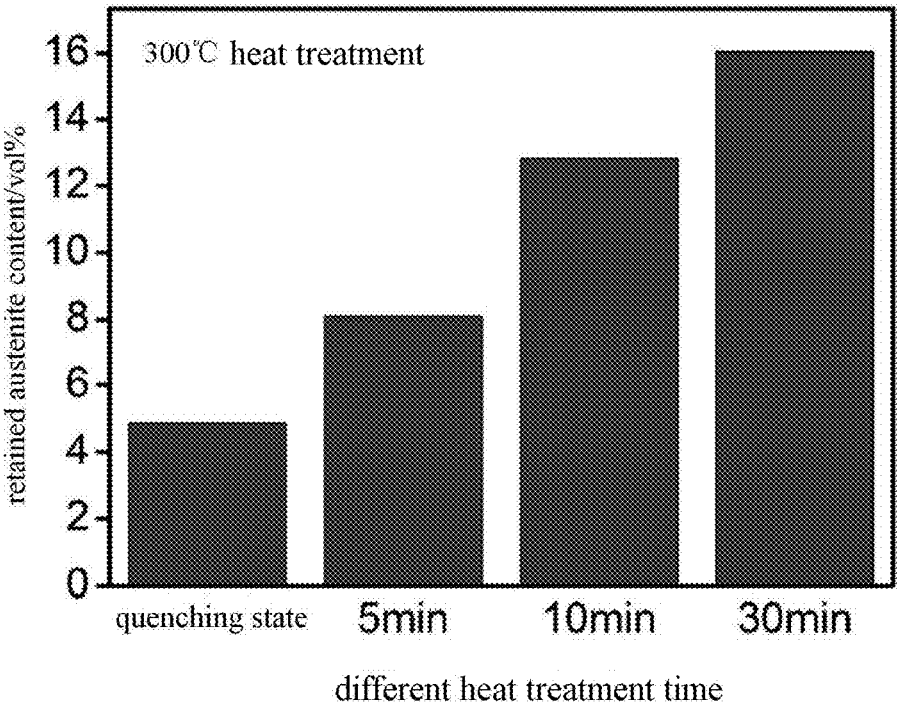

Moreover, it can be known by analysing the microstructure of the steel of the present invention that the microstructure of the steel without being subject to the heat treatment comprises, by volume, 3% to 23% of retained austenite, 10% or less of ferrite, with the balance being martensite, or further containing 2% or less of carbides. After being subject to the heat treatment, the microstructure of the formed component comprises, by volume, 7% to 32% of retained austenite, 10% or less of ferrite, with the balance being martensite, or further containing 2% or less of carbides. FIG. 1A shows a tendency of retained austenite in the hot-rolled steel sheet of the present invention that varies with different heat treatment time at the same temperature, i.e., 250° C. FIG. 1B shows the tendency of retained austenite in the hot-rolled steel sheet of the present invention that varies with different heat treatment time at the same temperature, i.e., 300° C. FIG. 2A shows the variation in the amount of retained austenite in the cold-rolled steel sheet of the present invention at 250° C. under different heat treatment processes. FIG. 2B shows the variation in the amount of retained austenite in the cold-rolled steel sheet of the present invention at 300° C. under different heat treatment processes. As these figures show, under different heat treatment processes, the amount of retained austenite in the steel sheet of the present invention generally increases with time.

Figure 3:
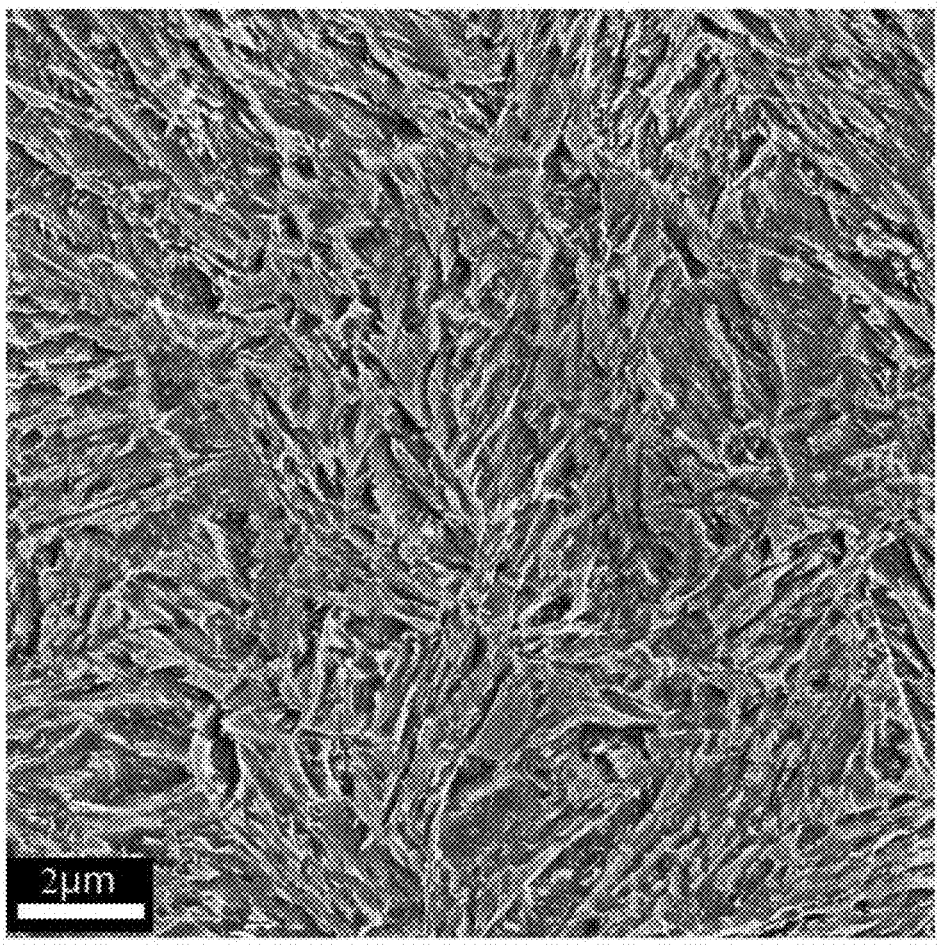
FIG. 3 shows a microstructure of an embodiment of the steel of the present invention after the heat treatment of the present invention.
Figure 4:
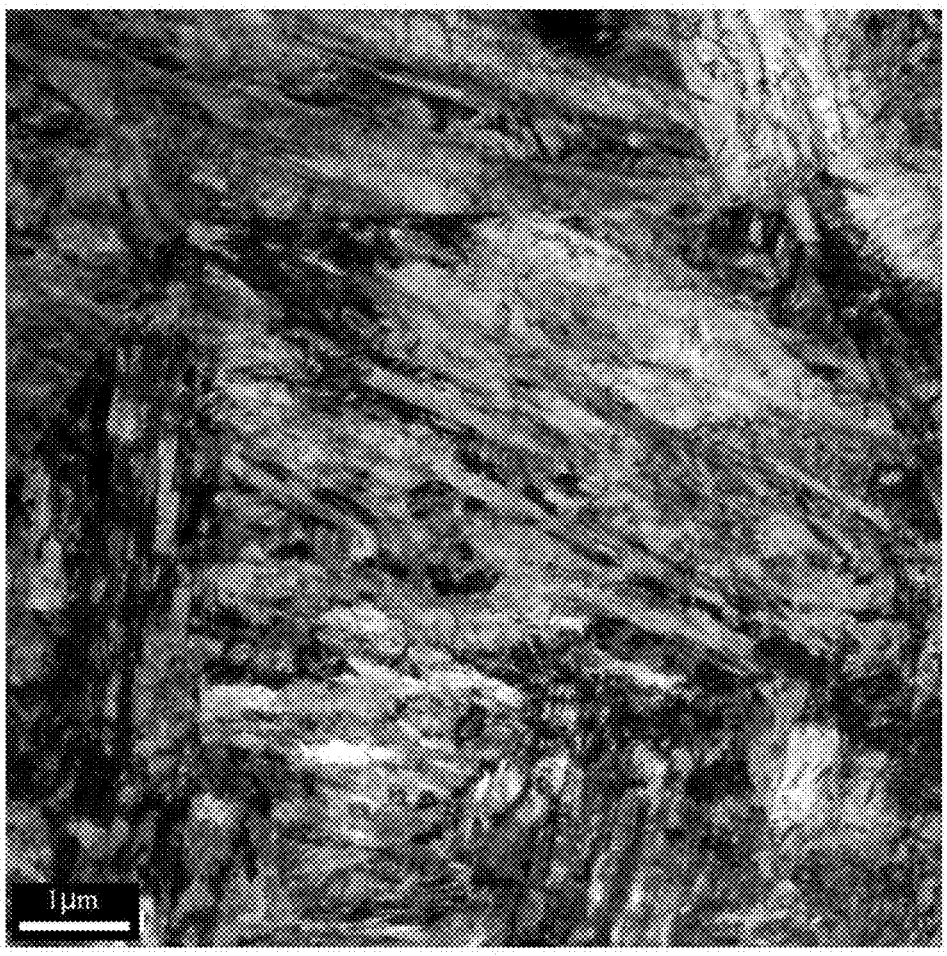
FIG. 4 shows a typical lath distribution microstructure of the steel of the present invention after the heat treatment of the present invention.

A small fraction of retained austenite is not good to improving the ductility of a component, whereas a high volume fraction of retained austenite will cause austenite to form into coarse blocks, which will transform into brittle blocky martensite by TRIP effect during tensile deformation or collision deformation, which is bad to improving the ductility of the component. Thus, the present invention controls the martensitic transformation start temperature point to be not more than 280° C. and the quenching temperature to be 150 to 260° C. below the martensitic transformation start temperature point, so as to guarantee a reasonable volume fraction of austenite and a lath (or film) like morphology. FIG. 3 shows the microstructure after being subjected to the heat treatment for 5 minutes at 300° C. after austenitizing treatment. And FIG. 4 shows a typical lath distribution microstructure.

The above embodiments are typical embodiments of the present invention. Without departing from the inventive concept disclosed herein, those skilled in the art can make any modifications to the above embodiments that still fall within the scope of the present invention.

What is claimed is:

1. A hot-stamped formed component, characterized in that the formed component is manufactured of steel sheet by means of a hot stamping process, wherein the steel sheet comprises by weight percent 0.18~0.42% of C, 5.09~8.5% of Mn, and 0.8~3.0% of Si+Al with the balance being Fe and unavoidable impurities, wherein the alloy elements of the steel sheet enable the actual measured value of the martensitic transformation start temperature of the steel sheet after hot stamping to be ≤280° C., the hot stamping process comprises the steps of:

a) providing the steel sheet or its preformed component;

b) heating the steel sheet or its preformed component to a temperature ranging from 700 to 850° C.;

c) transferring the heated steel sheet or its preformed component to a die for stamping so as to obtain a formed component; and d) cooling the formed component to a temperature that is 150 to 260° C. below the martensitic transformation start temperature point by any cooling method and under any cooling condition, wherein the hot-stamped formed component is also subjected to a tempering heat treatment step after the step d), in the tempering heat treatment step, the formed component is heated to a temperature ranging from 160 to 450° C. and then maintaining the temperature for 1 to 100000 seconds, and then cooling the formed component to room temperature by any cooling method and under any cooling condition, wherein the tempering heat treatment step is conducted immediately after the step d) or after the formed component that has been subjected to the step d) is placed for a period of time, wherein the microstructure of the formed component comprises, by volume, 7% to 32% of retained austenite and 10% or less of ferrite with the balance being martensite, and wherein the formed component has a yield strength of 1200 MPa or more, a tensile strength of 1600 MPa or more and an elongation of 10% or more.

2. The hot-stamped formed component according to claim 1, characterized in that the formed component is used as at least one of a safety structural component, a reinforcement structural component, a wheel component, and a structural component of land vehicles.

3. The hot-stamped formed component according to claim 2, characterized in that the formed component is used as at least one of a B column reinforcement, a bumper, a car door anti-collision beam and a wheel spoke.

4. The hot-stamped formed component according to claim 1, characterized in that the formed component further contains 2% or less of carbides.

* * * * *